US009291976B2

(12) United States Patent
Hashii et al.

(10) Patent No.: US 9,291,976 B2
(45) Date of Patent: Mar. 22, 2016

(54) IMAGE FORMING APPARATUS HAVING A CONVEYING PATH, OPTION APPARATUS AND IMAGE FORMING SYSTEM

(71) Applicant: CANON KABUSHIKI KAISHA, Tokyo (JP)

(72) Inventors: Hiroki Hashii, Yokohama (JP); Ryuichi Yoshizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/748,858

(22) Filed: Jun. 24, 2015

(65) Prior Publication Data

US 2016/0004203 A1 Jan. 7, 2016

(30) Foreign Application Priority Data

Jul. 2, 2014 (JP) ..... 2014-137064

(51) Int. Cl.
*G03G 15/00* (2006.01)

(52) U.S. Cl.
CPC ..... *G03G 15/6529* (2013.01); *G03G 15/6502* (2013.01); *B65H 2513/10* (2013.01); *G03G 2215/00945* (2013.01)

(58) Field of Classification Search
CPC ..... G03G 15/6502; G03G 2215/00945; B65H 2513/10
See application file for complete search history.

(56) References Cited

U.S. PATENT DOCUMENTS

| | | | | |
|---|---|---|---|---|
| 6,301,452 | B1 | 10/2001 | Yoshizawa | |
| 7,595,912 | B2 | 9/2009 | Takahashi et al. | |
| 7,729,005 | B2 | 6/2010 | Okanishi et al. | |
| 7,916,318 | B2 | 3/2011 | Nakamura et al. | |
| 8,531,695 | B2 | 9/2013 | Nakamura et al. | |
| 2006/0237902 | A1 * | 10/2006 | Yoshizawa | B65H 5/34 271/258.01 |

FOREIGN PATENT DOCUMENTS

| | | | |
|---|---|---|---|
| JP | 2005-345980 | A | 12/2005 |
| JP | 2008-105772 | A | 5/2008 |
| JP | 2008-213187 | A | 9/2008 |
| JP | 2013-129512 | A | 7/2013 |

* cited by examiner

*Primary Examiner* — Daniel J Colilla
*Assistant Examiner* — John M Royston
(74) *Attorney, Agent, or Firm* — Fitzpatrick, Cella, Harper & Scinto

(57) ABSTRACT

An image forming system includes an option apparatus having a first conveying path; and an image forming apparatus having a second conveying path configured to be connected to the first conveying path. The image forming apparatus includes a sensor configured to detect a recording material conveyed on the second conveying path at a first speed; and a first controller configured to notify the option apparatus of a detection timing of the recording material. The option apparatus includes a second controller configured to determine whether the detection timing is different from a predetermined timing upon receiving a notification of the detection timing, and, if it is different, to determine a second speed based on the detection timing and the predetermined timing and change the conveying speed of the recording material from the first speed to the second speed.

16 Claims, 11 Drawing Sheets

IMAGE FORMING APPARATUS HAVING A CONVEYING PATH, OPTION APPARATUS AND IMAGE FORMING SYSTEM

BACKGROUND OF THE INVENTION

1. Field of the Invention

This disclosure relates to a conveying speed control technique of a recording material in an image forming system including an image forming apparatus for forming an image onto the recording material, and an option apparatus for receiving/passing the recording material from/to the image forming apparatus.

2. Description of the Related Art

Japanese Patent Laid-Open No. 2005-345980 discloses a configuration, in an image forming system including an image forming apparatus and an option apparatus for receiving/passing a recording material from/to the image forming apparatus, for switching the conveying speed of the recording material while the image forming apparatus and the option apparatus are synchronizing with each other. Specifically, the option apparatus is notified of switching of the conveying speed by outputting a binary level signal from the image forming apparatus to the option apparatus.

However, the configuration described in Japanese Patent Laid-Open No. 2005-345980 is one for performing switching between two predetermined conveying speeds, but not enabling switching among other multiple conveying speeds. Therefore, it was difficult to achieve synchronization between the image forming apparatus and the option apparatus if the image forming apparatus performs acceleration/deceleration control so as to set a conveying speed other than the predetermined conveying speeds such that the position of the recording material being conveyed is corrected.

SUMMARY OF THE INVENTION

According to an aspect of the present invention, an image forming system includes: an option apparatus having a first conveying path; and an image forming apparatus configured to be connected to the option apparatus and having a second conveying path configured to be connected to the first conveying path of the option apparatus when the image forming apparatus is connected to the option apparatus. The image forming apparatus includes: a sensor configured to detect a recording material conveyed on the second conveying path at a first speed; and a first controller configured to notify the option apparatus of a detection timing of the recording material by the sensor, and, if the detection timing is different from a predetermined timing, to determine a second speed based on the detection timing and the predetermined timing and change the conveying speed of the recording material on the second conveying path from the first speed to the second speed. The option apparatus includes a second controller configured to determine whether the detection timing is different from the predetermined timing upon receiving a notification of the detection timing from the image forming apparatus, and, if the detection timing is different from the predetermined timing, to determine the second speed based on the detection timing and the predetermined timing and change the conveying speed of the recording material on the first conveying path from the first speed to the second speed.

Further features of the present invention will become apparent from the following description of exemplary embodiments with reference to the attached drawings.

DESCRIPTION OF THE EMBODIMENTS

Exemplary embodiments of the present invention will be described as below with reference to drawings. It should be noted that following embodiments are illustrative and do not limit the invention to the contents of the embodiments. Furthermore, in each of the following drawings, components that are not necessary to explain the embodiments are omitted.

First Embodiment

Figure 1:
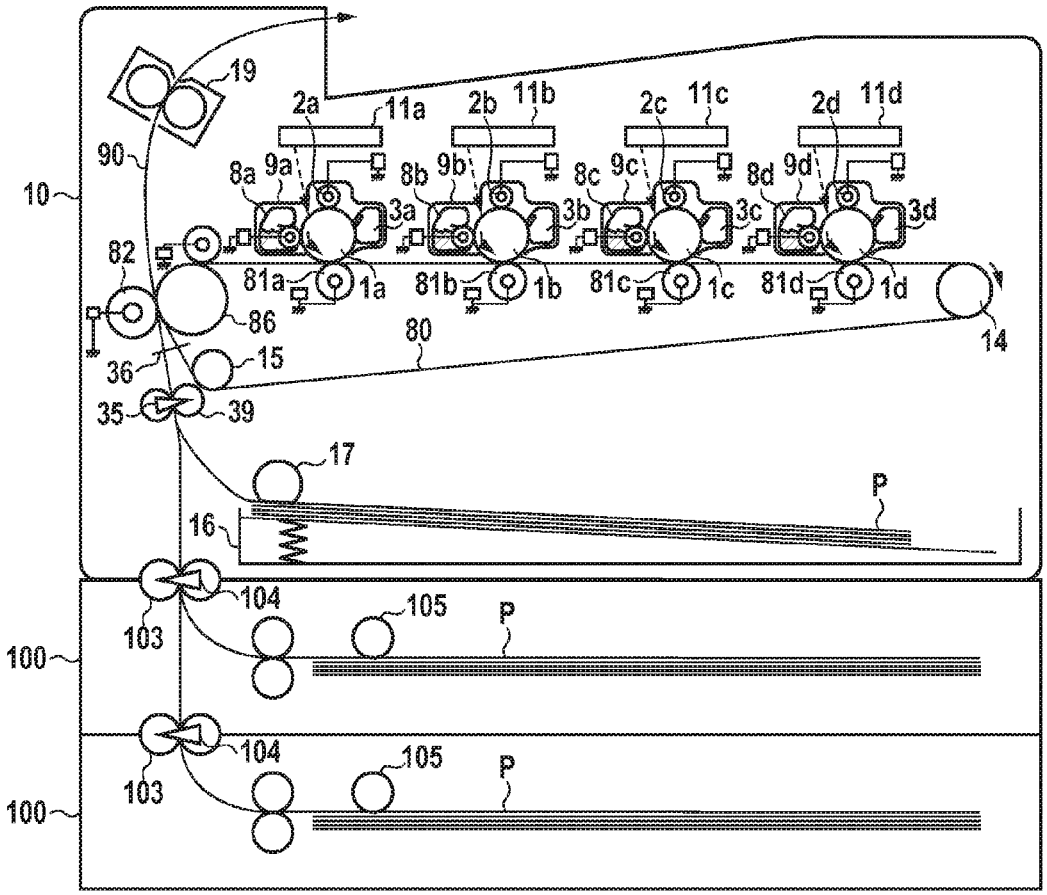
FIG. 1 is a configuration diagram of an image forming system according to one embodiment.

FIG. 1 is a configuration diagram of an image forming system in accordance with this embodiment. The image forming system has an image forming apparatus 10 and one or more option apparatuses 100. In this embodiment, the option apparatus 100 accommodates a recording material, and serves as a paper feeder to feed the accommodated recording material to the image forming apparatus 10. However, the option apparatus 100 can be any apparatus for receiving and passing the recording material from/to the image forming apparatus 10. The image forming system of FIG. 1 is configured to have two option apparatuses 100 connected in series to the image forming apparatus 10. Moreover, the configuration is such that the image forming apparatus 10 and the option apparatuses 100 are connected together, resulting in the connection between the conveying path of the recording material within the image forming apparatus 10 and the conveying paths of the recording material within the option apparatuses 100 so as to form one conveying path 90 as a whole. Additionally, a, b, c and d at the end of reference signs in FIG. 1 indicate that the colors of the toner images formed by corresponding members are yellow, magenta, cyan and black, respectively. Note that in the following description, reference numerals will be used without the alphabets at the ends if there is no need to distinguish colors.

During image forming, photosensitive members 1 that serve as image carriers are rotary-driven in the direction of the arrows in the drawing. Charging rollers 2 charge the surfaces of the corresponding photosensitive members 1 to a uniform potential. Exposure units 11 scan with and expose to a light the surfaces of the photosensitive members 1 in accordance with images to be formed, and form electrostatic latent images onto the photosensitive members 1. Developing units 8 visualize the electrostatic latent images formed on the photosensitive members 1 as toner images by letting toner deposit on them. Primary transferring rollers 81 transfer to an intermediate transfer belt 80 the toner images formed on the photosensitive members 1. Note that a multi-color toner image is formed by superimposing the toner images formed on the respective photosensitive members 1 to the intermediate transfer belt 80. Cleaning units 3 remove the toner that was not transferred to the intermediate transfer belt 80 but remains on the photosensitive members 1. Note that the photosensitive member 1, the cleaning unit 3, the charging roller 2 and the developing unit 8 are configured as an integral process cartridge 9 that is detachable from the image forming apparatus.

The intermediate transfer belt 80 is tensioned by rollers 86, 14 and 15, and rotary-driven in the direction of the arrow in the drawings depending on the rotation of the roller 14. The toner image transferred to the intermediate transfer belt 80 is conveyed by the rotation thereof to an opposing position of a secondary transferring roller 82. In a case of paper-feeding from a main body cassette 16, a pickup roller 17 is driven such that a recording material P is fed out to the conveying path 90. Note that the recording material is conveyed on the conveying path 90 by the rotation of a plurality of rollers provided along the conveying path 90. In a case of paper-feeding from the option apparatus 100, a pickup roller 105 of the option apparatus 100 that perform paper-feeding is driven such that the recording material P is fed out to the conveying path 90. The option apparatus 100 has a conveying roller 103 and a sensor 104 at a connecting place to an option apparatus 100 downstream in the conveying direction or to the image forming apparatus 10. The conveying roller 103 conveys the recording material conveyed from upstream into the option apparatus 100 immediately downstream thereof or into the image forming apparatus 10. The sensor 104 performs detection of the recording material conveyed from upstream.

A sensor 35 detects the recording material fed and conveyed from the cassette 16 or from the option apparatus 100. The image forming apparatus of this embodiment matches the timings when the leading head of the recording material and the leading head of the toner image formed on the intermediate transfer belt 80 reach the predetermined position 36, so as to transfer the toner image formed on the intermediate transfer belt 80 to the recording material conveyed on the conveying path 90. Accordingly, when the sensor 35 detects the recording material, depending on the timing thereof, the rotation speed of a roller 39, for example, is adjusted so as to adjust the conveying speed of the recording material. Note that before the leading edge of the recording material reaches the predetermined position 36, the conveying speed of the recording material returns to an original reference speed (first speed). This is done to match the moving speed of the rotating intermediate transfer belt 80 surface and the speed of the recording material. That is, in this embodiment, the reference speed is the same as the moving speed of the surface of an image carrier such as the intermediate transfer belt 80. In this way, the timings when the recording material and the toner image formed on the intermediate transfer belt 80 move past the opposing position of the secondary transferring roller 82 are adjusted, and the toner image is transferred to the recording material by the secondary transferring roller 82. The recording material with the toner image transferred thereto is thereafter conveyed to a fixing unit 19. The fixing unit 19 heats and pressurizes the recording material and fixes the toner image onto the recording material. After fixing the toner image, the recording material is ejected out of the image forming apparatus.

Figure 2:
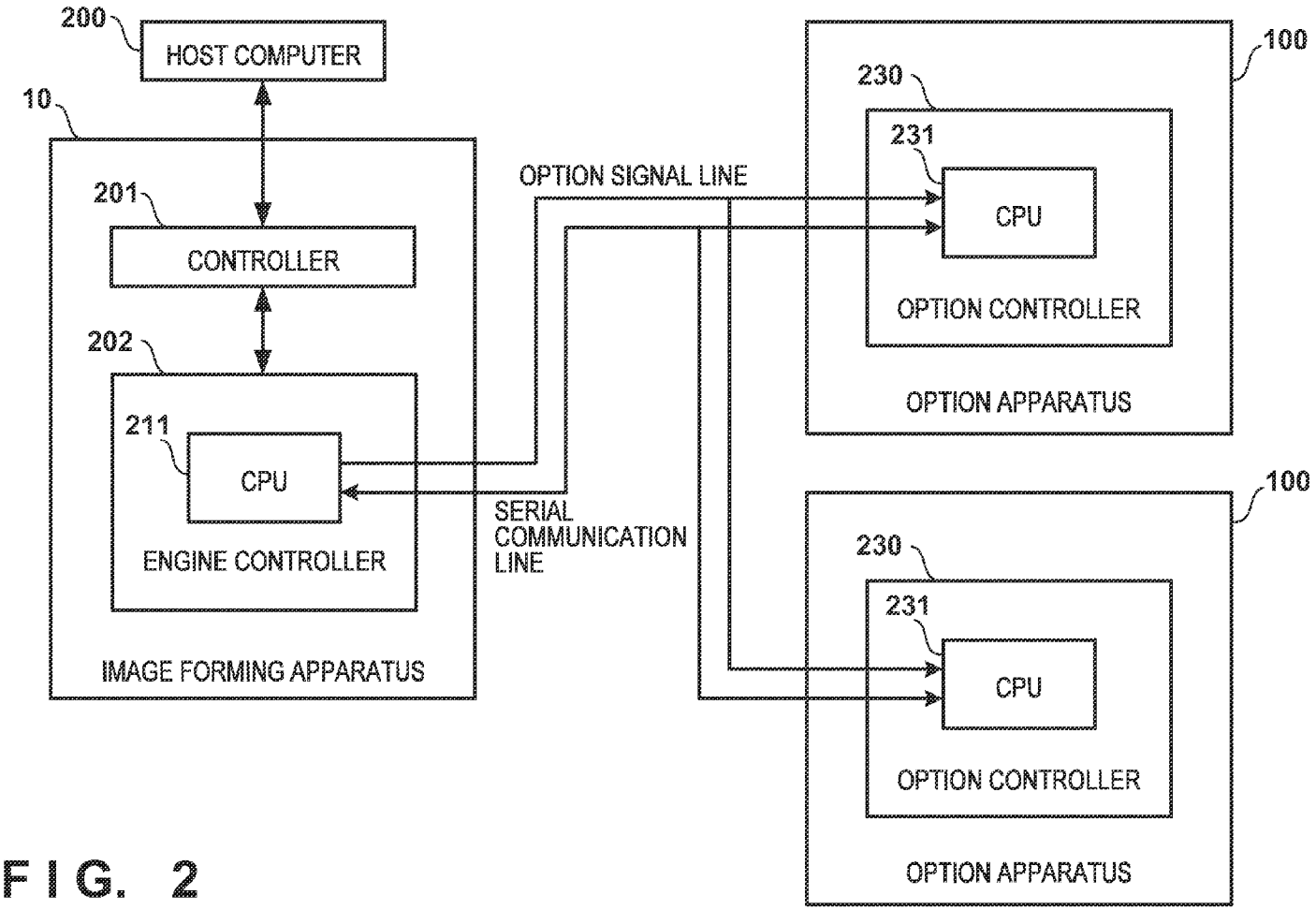
FIG. 2 is a control configuration diagram of the image forming system according to one embodiment.

FIG. 2 is a control configuration diagram of the image forming system. A controller 201 of the image forming apparatus 10, upon receiving image information and a print instruction from a host computer 200, analyzes the received image information and converts into video signals that are bit data. The controller 201 then sends out various commands such as a print reserve command and a print start command and the video signals to an engine controller 202, for every recording material to be printed. Upon receiving the print start command from the controller 201, the CPU 211 of the engine controller 202 performs a preparing operation for image forming, and when the preparation of image forming is made, it outputs to the controller 201 a /TOP signal, which serves as a reference timing for the output of the video signals. The controller 201, upon receiving the /TOP signal from the CPU 211, outputs the video signals based on the /TOP signal, and the engine controller 202, as described using FIG. 1, controls each unit of the image forming apparatus 10 and performs image forming. Note that the controls performed by the CPU 211 includes conveying speed control of the recording material by controlling the rotation speed of the conveying rollers, e.g. the roller 39, for the recording material within the image forming apparatus 10. Additionally, the engine controller 202 is provided with a memory (not shown), and the CPU 211 performs various controls by executing programs stored in the memory. The memory can also be used as a storing region for data used by the CPU 211 and temporary data in processing by the CPU 211. Note that the processing by the CPU 211 can be realized as hardware by using ASIC, etc. and as a combination of the processing by the CPU 211 and the processing by ASIC, etc.

Additionally, the option apparatus 100 has an option controller 230 provided with a CPU 231. The option controller 230 is provided with a memory (not shown), and the CPU 231 performs various controls by executing programs stored in the memory. Note that the controls performed by the CPU 231 include the conveying speed control of the recording material by controlling the rotation speed of the conveying rollers, e.g. the roller 103, for the recording material within the option apparatus 100. Note that the memory (not shown) is also used as a storing region for data used by the CPU 231 and temporary data in processing by the CPU 231. Note that the processing by the CPU 231 can be realized as hardware by using ASIC, etc. and as a combination of the processing by the CPU 231 and the processing by ASIC, etc. The CPU 231 is connected to the CPU 211 through a serial communication line, and through serial communication using this serial communication line, paper-feeding, conveying control and so on of the recording material are performed in accordance with the instructions from the CPU 211. Additionally, the CPU 211 and the CPU 231 are connected together by an option signal line in order to achieve timing synchronization of the conveying speed controls. The engine controller 202 transmits the timing of the conveying speed control by inverting the output level of the option signal line.

Figure 3:
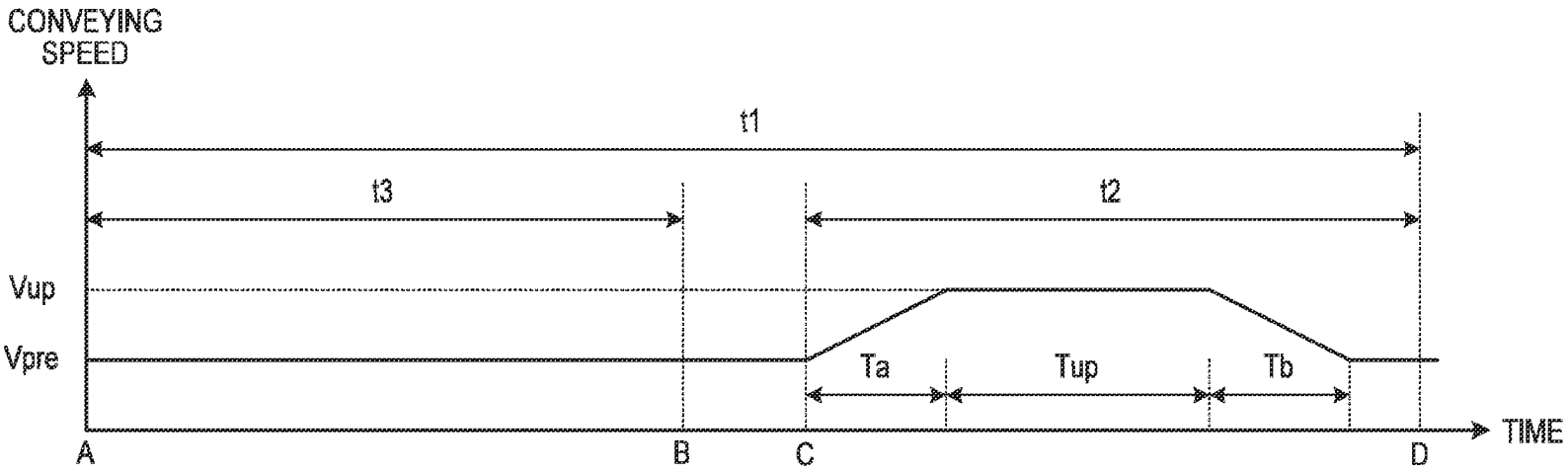
FIG. 3 is a timing chart of conveying speed control according to one embodiment.

FIG. 3 is an explanatory diagram of the conveying speed control in the image forming apparatus. The conveying speed control is a control in which the sensor 35 detects the leading end of the recording material in order to align the leading end of the recording material and the leading end of the toner image at the predetermined position 36. Specifically, the conveying speed is controlled based on the difference between a theoretical value where the recording material reaches the detection position of the sensor 35 and a time when the sensor 35 actually detected the leading end of the recording material. A time A in FIG. 3 is a timing when the engine controller 202 outputted the /TOP signal and started image forming, and a time D is a timing for the leading end of the toner image formed on the intermediate transfer belt 80 to reach the predetermined position 36. Additionally, a time B is an ideal timing for the recording material to reach the detection position of the sensor 35. For example, if the sensor 35 detects the leading end of the recording material at the time B, then, by conveying still at a reference speed Vpre without changing the conveying speed, the timings for the leading end of the recording material and for the leading end of the toner image formed on the intermediate transfer belt 80 to reach the predetermined position 36 will be matched. A time C is a timing when the sensor 35 actually detected the leading end of the recording material, and in this example, the recording material had reached the detection position of the sensor 35 later than the ideal timing.

In the example of FIG. 3, after the sensor 35 detects the recording material, the conveying speed needs to be increased so as to make up for delay, as described as below. First, a time period t1 from the output of the /TOP signal until the time D and a time period t3 until the time B are predetermined values, and by the sensor 35 detecting the recording material, a time period t2 from the time C to the time D is determined. This allows the engine controller 202 to obtain time difference from the ideal time $\Delta t = t1 - t2 - t3$.

Due to the time difference Δt, the recording material will be conveyed with the delay of the following distance U1;

$$U1 = \Delta t \times Vpre \quad (1)$$

The delay of the distance U1 thus needs to be made up for before the recording material reaches the predetermined position 36. Now, a conveying speed to make up for the delayed distance is referred to as Vup, and a conveying time period at the conveying speed Vup is referred to as Tup. Additionally, a time period required to change the conveying speed from the reference speed Vpre to Vup, and a time period required to change the conveying speed from Vup to the reference speed Vpre are referred to as Ta and Tb, respectively. In this case, a distance U2 that can be made up for by increasing the conveying speed is $$U2 = (Tup + (Ta + Tb)/2) \times (Vup - Vpre) \quad (2)$$

Now, because U1=U2, it is necessary to determine Vup, Tup, Ta and Tb to support $$(\Delta t \times Vpre)/(Vup - Vpre) = Tup + (Ta + Tb)/2 \quad (3)$$

as derived from expressions (1) and (2). Note that because it is necessary to return the conveying speed to the reference speed Vpre within the time period t2, the condition of $$t2 > Tup + Ta + Tb \quad (4)$$

is imposed. Deriving from expressions (3) and (4), the condition of $$t2 > (\Delta t \times Vpre)/(Vup - Vpre) + (Ta + Tb)/2 \quad (5)$$

needs to be satisfied. Now, with an absolute value of acceleration speed and deceleration speed of the conveying speed of the recording material referred to as α, $$Ta = Tb = (Vup - Vpre)/\alpha \quad (6)$$

holds true, and $$(Vup - Vpre)^2 - (\alpha \times t2)(Vup - Vpre) + \alpha(\Delta t \times Vpre) < 0 \quad (7)$$

is obtained from expressions (5) and (6). By solving the expression (7) for Vup, Vup can be obtained. Moreover, by obtaining Vup, Tup can be obtained as well. Note that FIG. 3 represents the case where the time C when the recording material reached the detection position of the sensor 35 is later than the ideal time B, but in the case where the reaching time C is earlier than the ideal time B, the same can be applied except that the conveying speed is decreased lower than Vpre.

Figure 4:
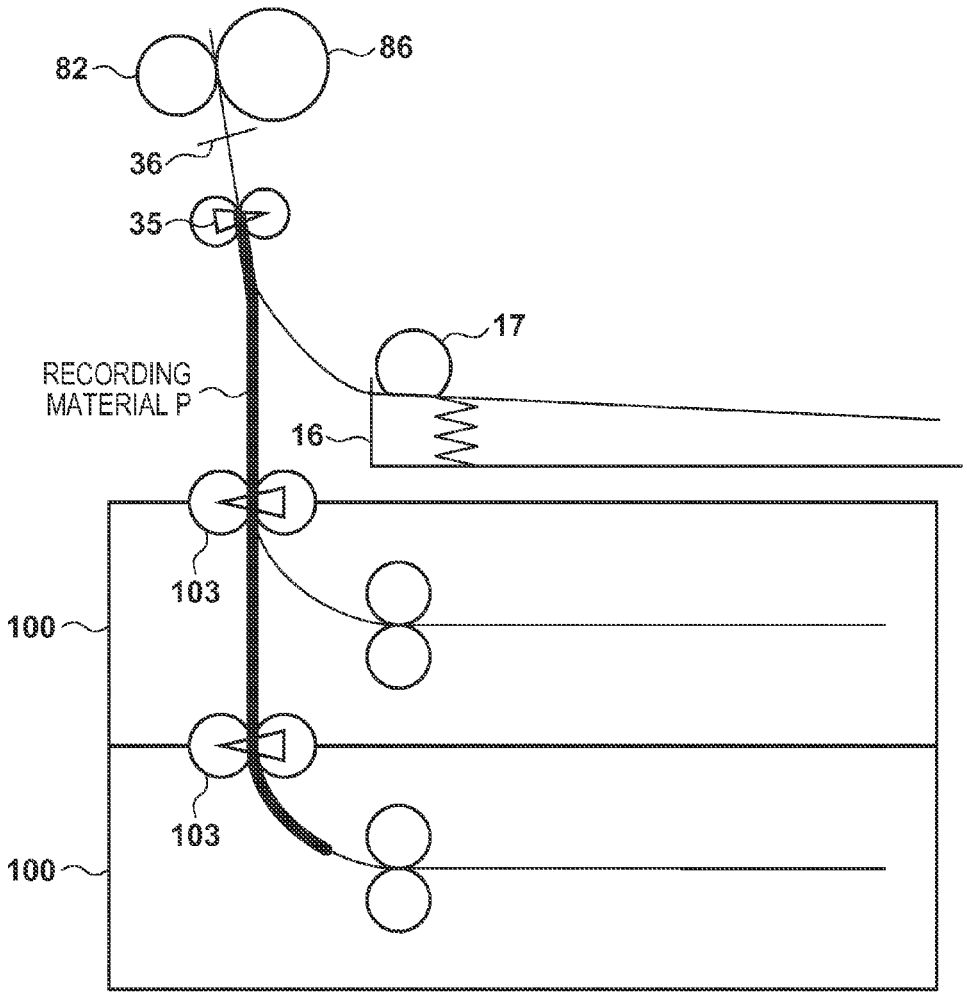
FIG. 4 is an explanatory diagram for the reason for performing the conveying speed control.

FIG. 4 shows a state in which the recording material P fed from the option apparatus 100 of the lowermost stage is sandwiched between the conveying rollers 103, and its leading end has reached the detection position of the sensor 35. The engine controller 202 starts conveying speed control from the state shown in FIG. 4, so as to eliminate the variation of timing for the recording material to reach the detection position of the sensor 35. In this case, in order to surely convey the recording material, the option apparatus 100 also has to be controlled to have the same and simultaneous conveying operation as the image forming apparatus 10. Otherwise, the option apparatus 100 would cause the recording material to jam, or the recording material would be tensioned between the image forming apparatus 10 and the option apparatus 100. Accordingly, the changes in the conveying speeds by the image forming apparatus and by the option apparatus 100 need to be synchronized. As described with use of FIG. 3, when the timing of detecting the leading end of the recording material by the sensor 35 is determined, how to change the conveying speed is determined. In this embodiment, the CPU 211 and the CPU 231 are configured to determine how to change the conveying speed with the same predetermined algorism. Moreover, in this embodiment, through the option signal line in FIG. 2, the CPU 211 notifies the CPU 231 of the timing to start conveying speed control, for example, timing when the sensor 35 detected the leading end of the recording material.

Figure 5:
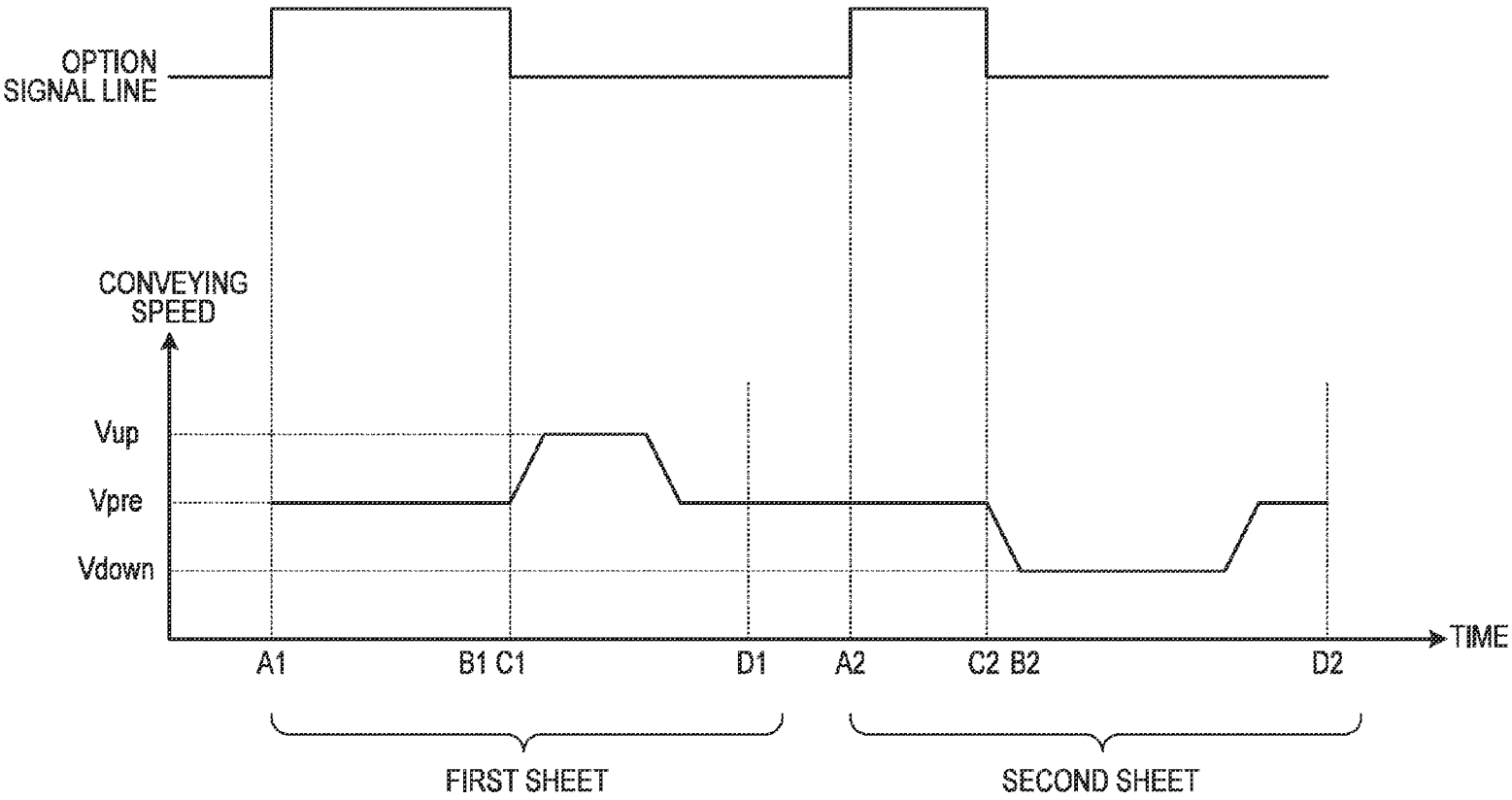
FIG. 5 is a timing chart of the conveying speed control according to one embodiment.

FIG. 5 shows an example of conveying speed control when forming images successively on two sheets of recording material in this embodiment. Note that times A1, B1, C1 and D1 represent, with regard to a first sheet, an output timing of the /TOP signal, an ideal time of the detection of the recording material by the sensor 35, a time when the sensor 35 actually detected the recording material, and a timing for the leading end of the toner image to reach the predetermined position 36, respectively. Similarly, times A2, B2, C2 and D2 represent, with regard to a second sheet, an output timing of the /TOP signal, an ideal time of the detection of the recording material by the sensor 35, a time when the sensor 35 actually detected the recording material, and a timing for the leading end of the toner image to reach the predetermined position 36, respectively. In FIG. 5, the time C1 comes after the time B1, that is, the first sheet of the recording material has reached the detection position of the sensor 35 later than the ideal timing. The CPU 211 changes the option signal line from Low level to High level at the time A1, and notifies the option apparatus 100 of the output timing of the /TOP signal before starting to convey the recording material. The CPU 211 also changes the option signal line from High level to Low level at the time C1, and notifies the option apparatus 100 of the timing of detection of the leading end of the recording material by the sensor 35. With the time A1 set as a reference, the time B1 is known to the image forming apparatus 10 and the option apparatus 100, thereby the image forming apparatus 10 and the option apparatus 100 determining that the timing when the sensor 35 detected the recording material is later than the ideal time. Accordingly, the image forming apparatus 10 and the option apparatus 100 each obtain how to change the conveying speed by the method described in FIG. 3, and control the conveying speeds in synchronization.

On the other hand, in FIG. 5, the time C2 comes before the time B2, that is, the second sheet of the recording material has reached the detection position of the sensor 35 earlier than the ideal timing. The CPU 211 changes the option signal line from Low level to High level at the time A2, and notifies the option apparatus 100 of the output timing of the /TOP signal. The CPU 211 also changes the option signal line from High level to Low level at the time C2, and notifies the option apparatus 100 of the timing of detection of the leading end of the recording material by the sensor 35. The time B2, with the time A2 set as a reference, is known to the image forming apparatus 10 and the option apparatus 100, thereby the image forming apparatus 10 and the option apparatus 100 recognizing that the timing when the sensor 35 detected the recording material is earlier than the ideal time. Accordingly, the image forming apparatus 10 and the option apparatus 100 each obtain how to change the conveying speed with the same algorism, and control conveying speeds in synchronization.

Figure 6:
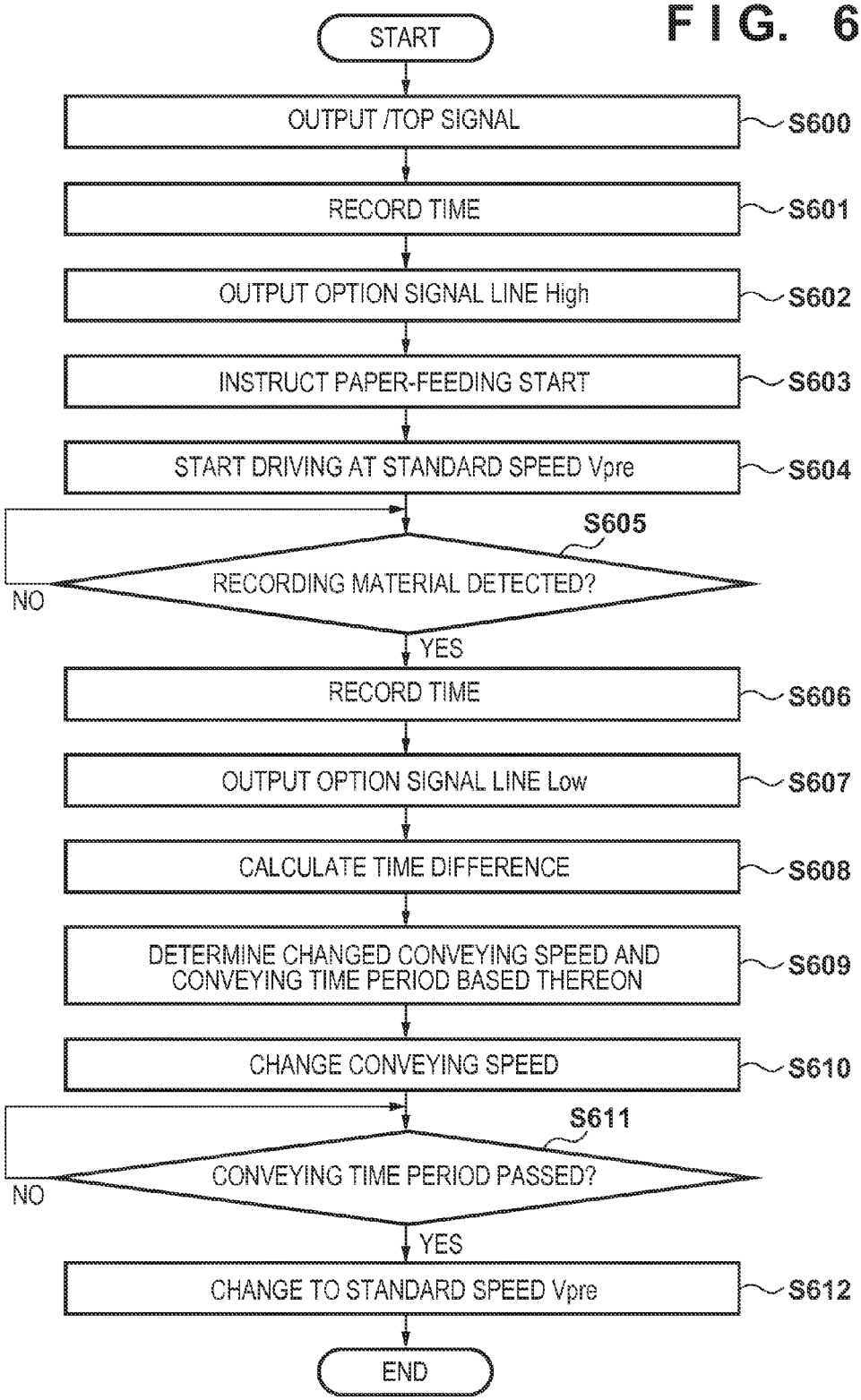
FIG. 6 is a flow chart of the processing executed by an engine controller in conveying speed control according to one embodiment.

FIG. 6 is a flow chart of the conveying speed control by the engine controller 202 of the image forming apparatus 10 in a case of paper-feeding from the option apparatus 100. The engine controller 202, in S600, outputs a /TOP signal to the controller 201, records that time in S601, and changes the option signal line from Low level to High level in S602. The engine controller 202, through the serial communication line, instructs the option controller 230 to start paper-feeding in S603, and drives the rollers of the conveying path 90 in S604 such that the conveying speed is the reference speed Vpre. Thereafter, the engine controller 202 waits for the sensor 35 to detect the recording material, in S605. When the sensor 35 detects the recording material, the engine controller 202 records that time in S606, and changes the option signal line from High level to Low level, in S607. The engine controller 202 calculates the time difference between the ideal time of detection of the recording material and the time of the actual detection by the sensor 35 in S608, and calculates a changed conveying speed and a conveying time period at the changed conveying speed, in S609. The engine controller 202 then changes the conveying speed to the speed determined in S610, waits for the conveying time period determined in S611, and in S612 returns the conveying speed to the original reference speed Vpre. Note that if there is no time difference in S608, the changed conveying speed will be equal to the reference speed Vpre.

Figure 7:
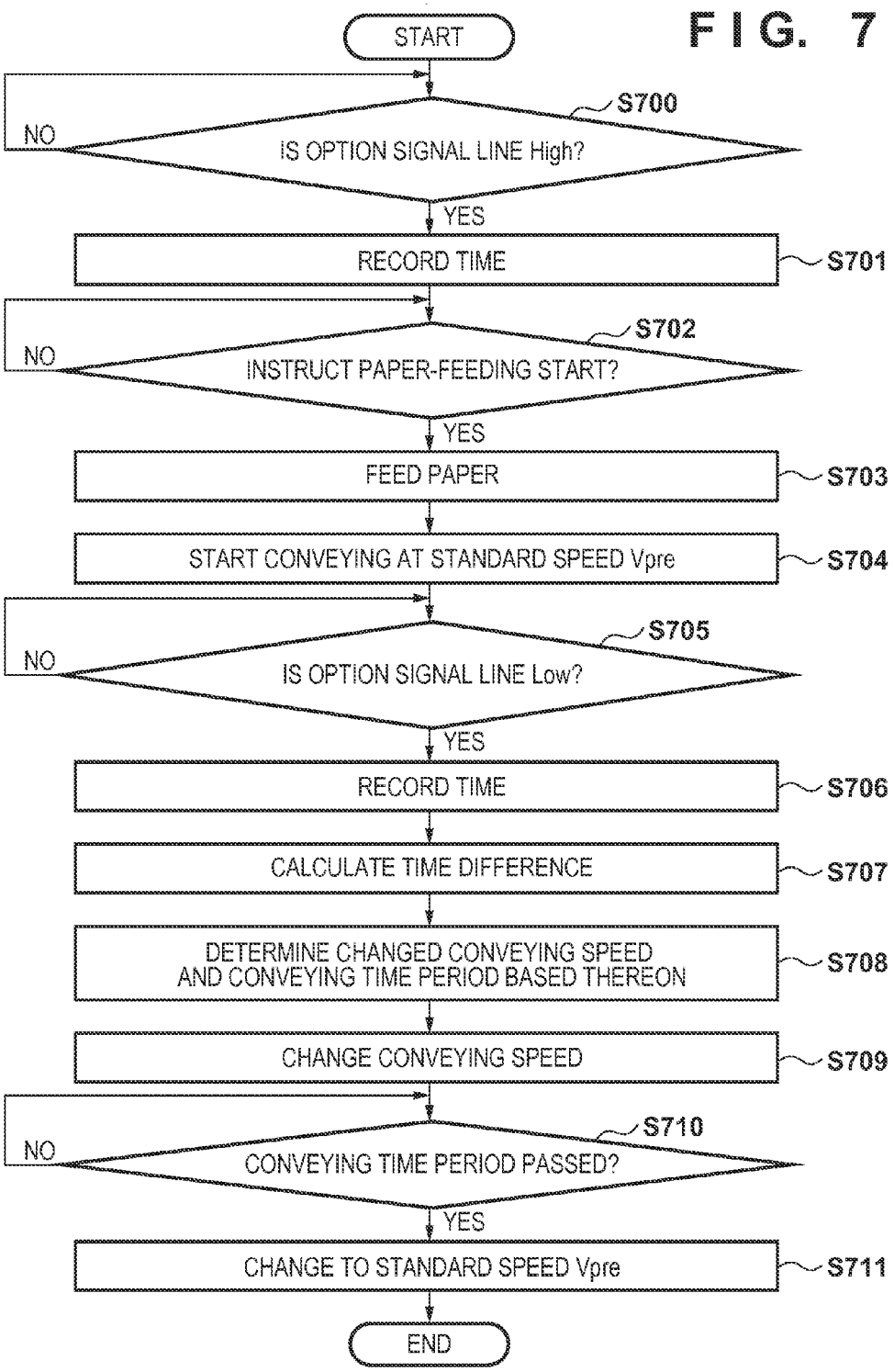
FIG. 7 is a flow chart of the processing executed by an option controller in conveying speed control according to one embodiment.

FIG. 7 is a flow chart of conveying speed control by the option controller 230 of the option apparatus 100 in a case of paper-feeding from the option apparatus 100. The option controller 230, in S700, waits for the option signal line to be at High level from Low level, and when the option signal line reaches High level, records that time in S701. In S702, the option controller 230 waits for paper-feeding start to be instructed through the serial communication line. When the paper-feeding start is instructed, the option controller 230, in S703, supplies the recording material to the conveying path 90, and in S704, conveys the recording material at the reference speed Vpre. Thereafter, the option controller 230, in S705, waits for the option signal line to be at Low level, and when it reaches Low level, records that time in S706. Consequent processes S707-S711 are similar to the processes S608-S612 in FIG. 6.

As described above, the conveying speed controls of the image forming apparatus 10 and the option apparatus 100 are synchronized based on the result of the detection by the sensor 35, whereby the recording material can be conveyed properly.

Second Embodiment

Figure 8A:
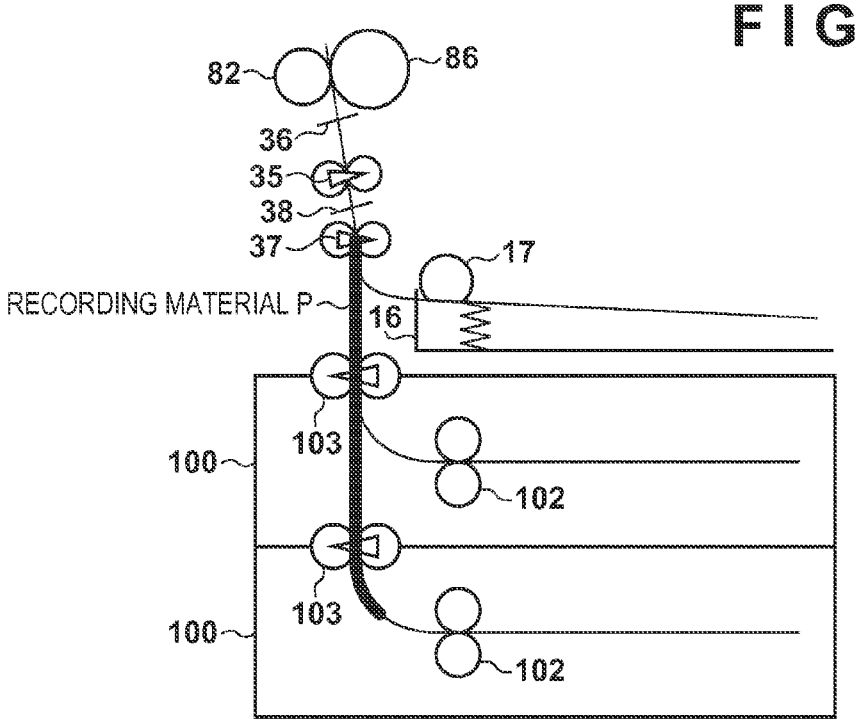
FIGS. 8A and 8B are explanatory diagrams of conveying speed control according to one embodiment.
Figure 8B:
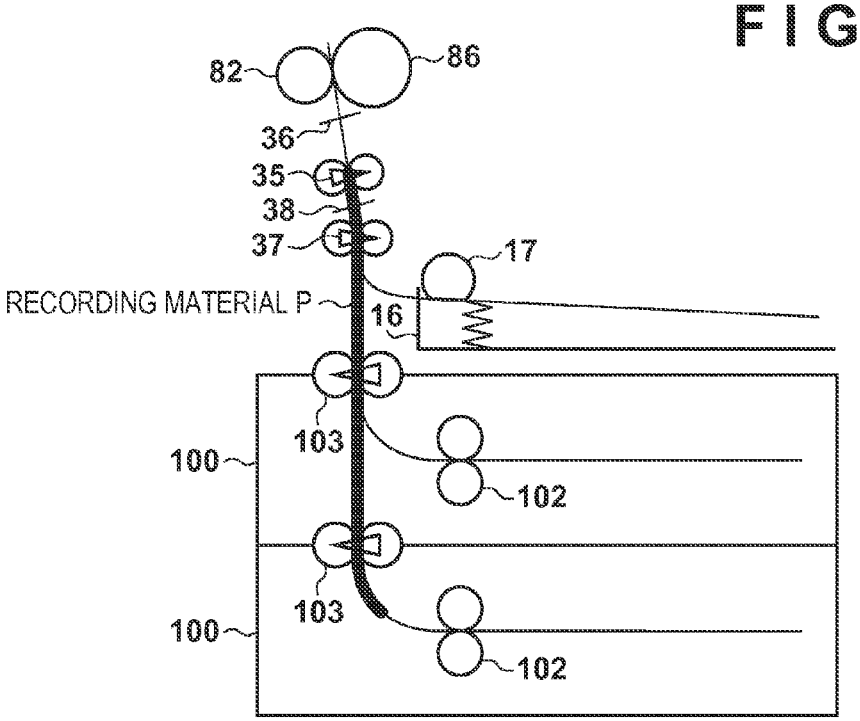

In the first embodiment, the conveying speed of the recording material is changed only once. In this embodiment, the conveying speed of the recording material will be changed a plurality of times. This embodiment will be described as below with regard to the case where the conveying speed is changed twice, that is, two conveying speed controls are performed, as an example. As shown in FIGS. 8A and 8B, in this embodiment, the image forming apparatus 10 is provided with a sensor 37 upstream of the sensor 35 in a conveying direction. Note that FIG. 8A shows a state where the leading end of the recording material P fed from the option apparatus 100 of the lowermost stage has been detected by the sensor 37. The engine controller 202 starts a first conveying speed control in order to eliminate the variation of the reaching timing when the sensor 37 detects the leading end of the recording material. Note that a reference numeral 38 represents an end position of the first conveying speed control. Note that the conveying speed control is similar in details to that of the first embodiment except that the sensor 35 and the predetermined position 36 are respectively replaced by the sensor 37 and the end position 38. Thereafter, when the sensor 35 detects the leading end of the recording material as shown in FIG. 8B, the engine controller 202 performs the second conveying speed control similarly to the first embodiment.

Figure 9:
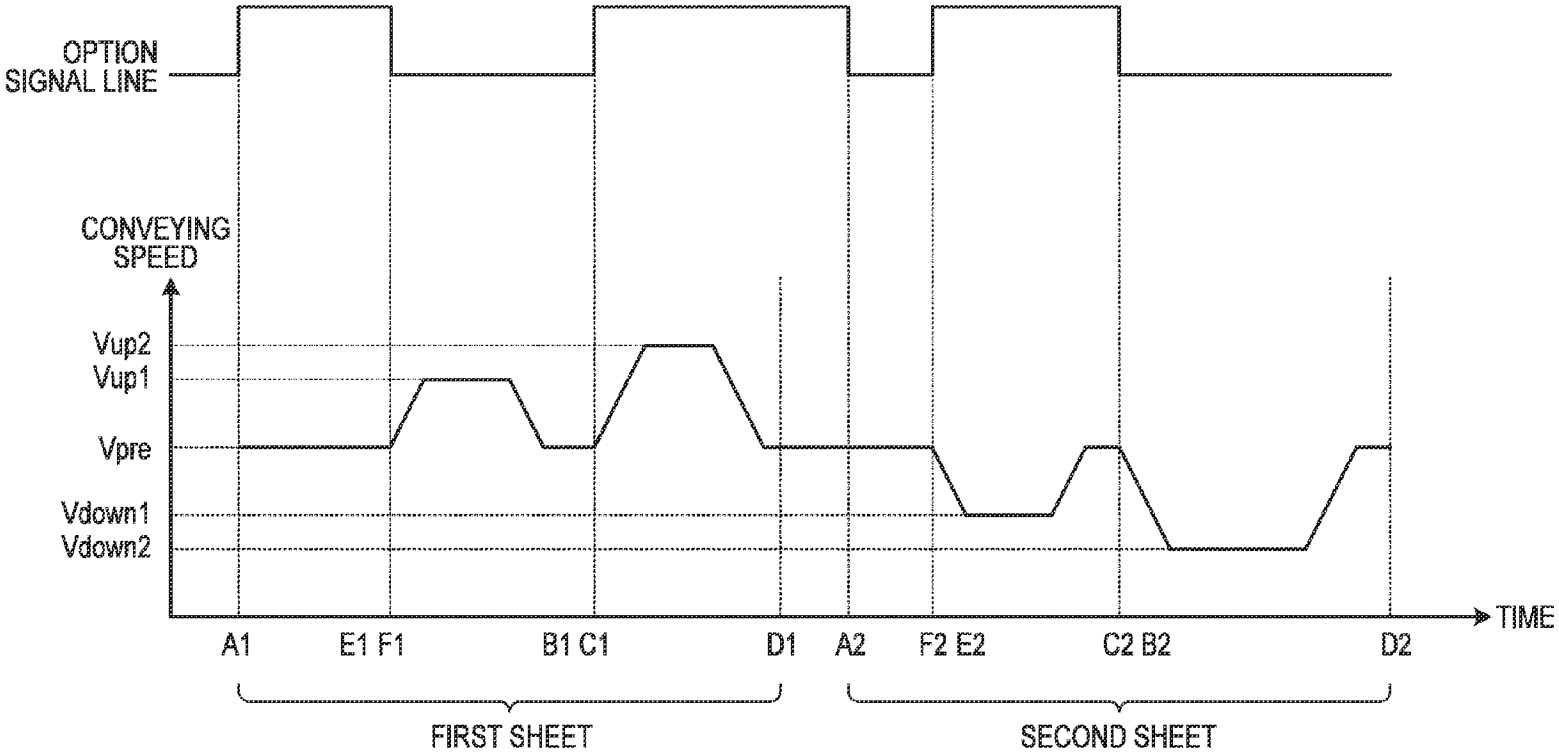
FIG. 9 is a timing chart of conveying speed control according to one embodiment.

FIG. 9 shows an example of conveying speed control when successively forming images onto two sheets of the recording material, in this embodiment. Note that the each meaning of times A1, A2, B1, B2, C1, C2, D1 and D2 is similar to those in FIG. 5. Additionally, times E1 and F1 represent, with regard to the first sheet, an ideal time of the detection of the recording material by the sensor 37, and a time when the sensor 37 actually detected the recording material, respectively. Similarly, times E2 and F2 represent, with regard to the second sheet, an ideal time of the detection of the recording material by the sensor 37, and a time when the sensor 37 actually detected the recording material, respectively.

In FIG. 9, the time F1 comes after the time E1, and the time C1 comes after the time B1. That is, the first sheet of the recording material has reached the detection positions of the sensor 37 and the sensor 35 later than the ideal times of the detection by both of the sensor 37 and the sensor 35. The CPU 211 notifies the option apparatus of the output timing of a /TOP signal by inverting the level of the option signal line at the time A1. The CPU 211 also notifies the option apparatus 100 of the detection of the leading end of the recording material by the sensor 37 by inverting the level of the option signal line at the time F1. The time E1, with the time A1 set as a reference, is known to the image forming apparatus 10 and the option apparatus 100, thereby the image forming apparatus 10 and the option apparatus 100 recognizing that timing of the recording material reaching the detection position of the sensor 37 is later than the ideal time. Accordingly, the image forming apparatus 10 and the option apparatus 100 each obtain how to change the conveying speed by the method described in FIG. 3, and control the conveying speed in synchronization. In this example, the image forming apparatus 10 and the option apparatus 100 each change the conveying speed temporally from the reference speed Vpre to Vup1. Thereafter, the CPU 211 notifies the option apparatus 100 of the detection of the leading end of the recording material by the sensor 35 by inverting the level of the option signal line at the time C1. This allows the CPU 211 and the CPU 231 to start the second conveying speed control similarly to the first embodiment. In this embodiment, during the second conveying speed control, the conveying speed is temporally changed to Vup2 that differs from Vup1.

Additionally, in FIG. 9, the time F2 comes before the time E2, and the time C2 comes before the time B2. That means, the second sheet of the recording material has reached the detection positions of the sensor 37 and the sensor 35 earlier than the ideal times of the detection by both of the sensor 37 and the sensor 35. The CPU 211 notifies the option apparatus 100 of the output timing of the /TOP signal, by inverting the option signal line at the time A2. The CPU 211 also notifies the option apparatus 100 of the detection of the leading end of the recording material by the sensor 37 by inverting the option signal line at time F2. The time E2, with the time A2 set as a reference, is known to the image forming apparatus 10 and the option apparatus 100, thereby the image forming apparatus 10 and the option apparatus 100 recognizing that the timing of the recording material reaching the detection position of the sensor 37 is earlier than the ideal time. Accordingly, the image forming apparatus 10 and the option apparatus 100 each obtain how to change the conveying speed and control the conveying speed in synchronization. In this example, the image forming apparatus 10 and the option apparatus 100 each have temporally changed the conveying speed from the reference speed Vpre to Vdown1. Thereafter, the CPU 211 inverts the level of the option signal line at the time C2 so as to notify the option apparatus 100 of the detection of the leading end of the recording material by the sensor 35. This allows the CPU 211 and the CPU 231 to start the second conveying speed control similarly to the first embodiment. In the second embodiment, during the second conveying speed control, the conveying speed is temporally changed to Vdown2 that differs from Vdown1.

Figure 10:
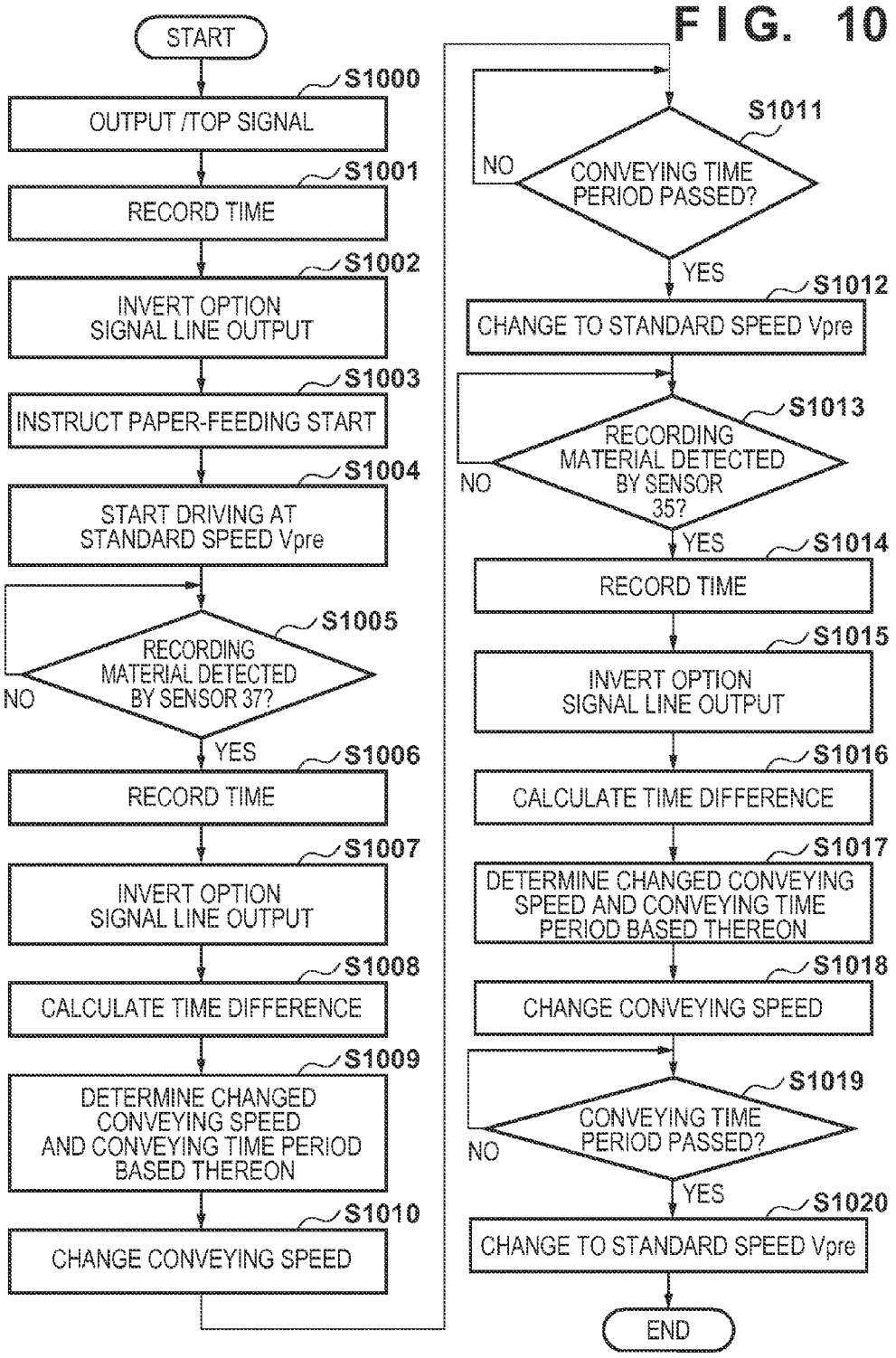
FIG. 10 is a flow chart of the processing executed by the engine controller in conveying speed control according to one embodiment.

FIG. 10 is a flow chart of conveying speed control by the engine controller 202 of the image forming apparatus 10 in a case of paper-feeding from the option apparatus 100. This embodiment differs from the first embodiment in that the level of the option signal line used for notification of the output of the /TOP signal and the detection of the recording material by the sensors 35 and 37 is not fixed and the notification is made simply by inverting the signal level. Note that there is no difference in that notifications of the output of the /TOP signal and the detection of the recording material are made by inverting the signal level of the option signal line also in the first embodiment. Processes S1000-S1012 in FIG. 10 are similar to the processes S600-S612 in FIG. 6, except that the sensor 35 replaces the sensor 37. Furthermore, processes S1013-S1020 are similar to the processes S605-S612 in FIG. 6.

Figure 11:
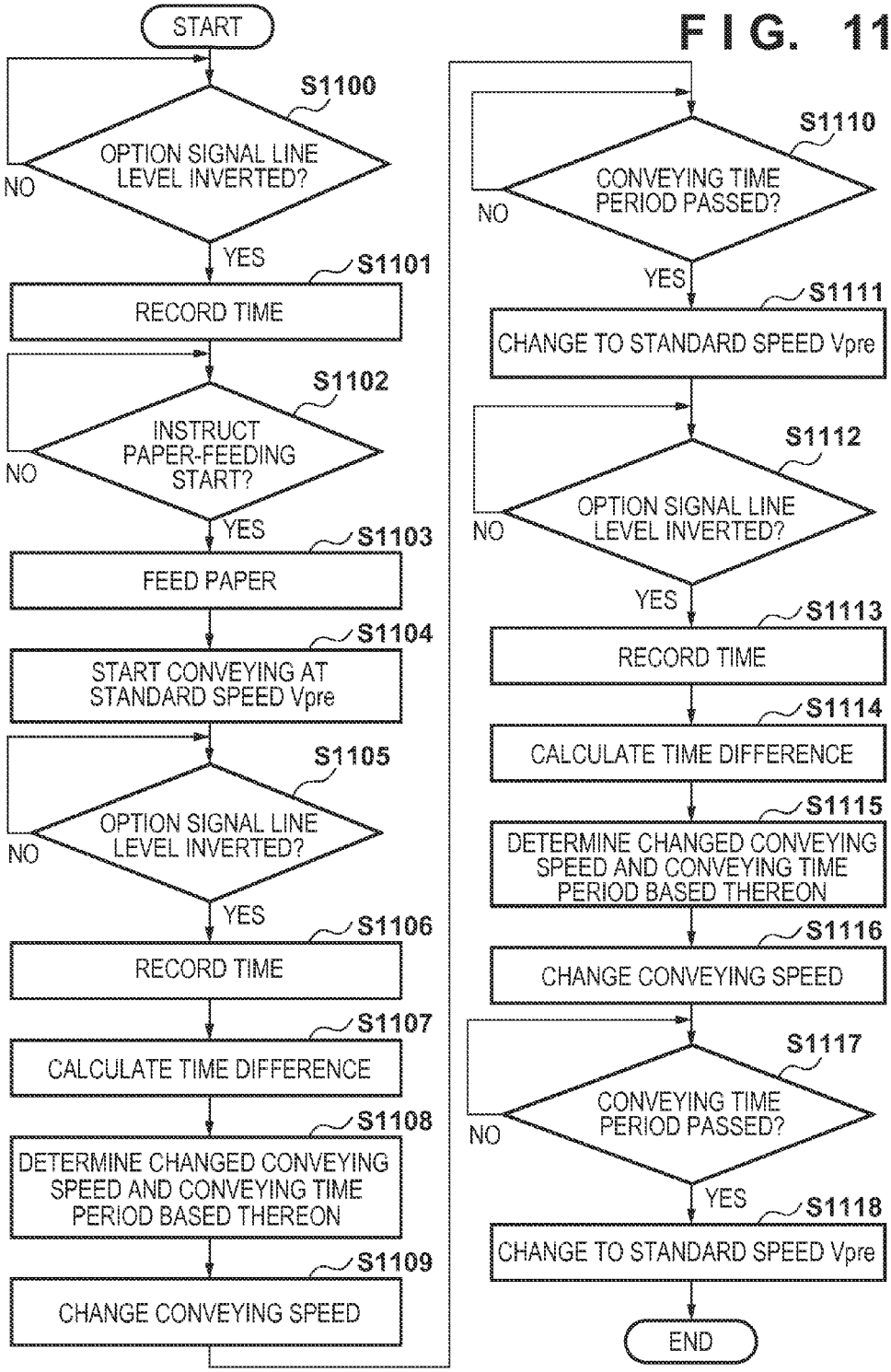
FIG. 11 is a flow chart of the processing executed by the option controller in conveying speed control according to one embodiment.

FIG. 11 is a flow chart of conveying speed control by the option controller 230 of the option apparatus 100 in a case of paper-feeding from the option apparatus 100. This embodiment differs from the first embodiment in that the level of the option signal line at which the output of the /TOP signal and the detection of the recording material by the sensors 35 and 37 are notified is not fixed and they are simply notified by inverting the signal level. Note that there is no difference in that the output of the /TOP signal and the detection of the recording material are notified by inverting the signal level of the option signal line also in the first embodiment. Processes S1100-S1111 in FIG. 11 are similar to the processes S700-S711 in FIG. 7. Furthermore, processes S1112-S1118 are similar to the processes S705-S711 in FIG. 6.

Due to the above configurations, it is possible to perform the conveying speed control synchronized between the image forming apparatus and the option apparatus.

The configuration to notify the option controller 230 of the conveying speed and the conveying time period calculated at the engine controller 202, unlike the configuration of the invention, is also conceivable. However, this configuration results in an increased amount of information to be sent to the option controller 230 via the signal line in comparison to the configuration of the invention. Thus, a problem of communication delay may arise. If communication delay occurs, the conveying speed controls synchronized between the image forming apparatus 10 and the option apparatus 100 cannot be performed properly. As a result, the option apparatus 100 would cause the recording material to jam, or the recording material would be tensioned between the image forming apparatus 10 and the option apparatus 100, possibly resulting in defects such as a scratch on the recording material. In the present invention, the sensor provided on the image forming apparatus 10 only has to notify the option apparatus 10 of the timing of the detection of the recording material, with a decreased amount of information to be transmitted via the signal line. This makes it possible to properly perform the conveying speed controls synchronized between the image forming apparatus 10 and the option apparatus 100, without occurrence of communication delay.

Other Embodiments

Moreover, in the above embodiments, the example of the paper-feeding option apparatus for paper-feeding the recording material to the image forming apparatus 10 was described as the option apparatus 100. However, there is no limitation to this. This invention can be applied even for a paper-discharge option apparatus for executing post-processing on the recording material discharged from the image forming apparatus 10, for example.

Moreover, in the above embodiments, the configuration of the image forming apparatus 10 having an option apparatus 100 connected thereto was described as an example. However, there is no limitation to this. The present invention can also be applied to an image forming apparatus having no option apparatus 100 connected thereto, for example. In this case, a configuration in which the image forming apparatus 10 has a first controller and a second controller communicating together through a signal line is also possible. The first controller among them controls a motor for rotating a first conveying roller for conveying the recording material. The second controller then controls a motor for rotating a second conveying roller for conveying the recording material that is located downstream of the first conveying roller in the direction of conveying the recording material. Moreover, the first controller is disposed near the first conveying roller, and controls the rotation speed of the first conveying roller based on the detection result of the sensor for detecting the recording material. The present invention can be now applied when performing conveying speed controls of the recording material synchronized between the first controller and the second controller.

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-137064, filed on Jul. 2, 2014, which is hereby incorporated by reference herein in its entirety.

What is claimed is:

1. An image forming system comprising:

an option apparatus having a first conveying path; and an image forming apparatus configured to be connected to the option apparatus and having a second conveying path configured to be connected to the first conveying path of the option apparatus when the image forming apparatus is connected to the option apparatus, wherein the image forming apparatus includes:

a sensor configured to detect a recording material conveyed on the second conveying path at a first speed; and a first controller configured to notify the option apparatus of a detection timing of the recording material by the sensor, and, if the detection timing is different from a predetermined timing, to determine a second speed based on the detection timing and the predetermined timing and change the conveying speed of the recording material on the second conveying path from the first speed to the second speed, and the option apparatus includes:

a second controller configured to determine whether the detection timing is different from the predetermined timing upon receiving a notification of the detection timing from the image forming apparatus, and, if the detection timing is different from the predetermined timing, to determine the second speed based on the detection timing and the predetermined timing and change the conveying speed of the recording material on the first conveying path from the first speed to the second speed.

2. The image forming system of claim 1, wherein the first controller is further configured to determine a conveying time period for conveying the recording material at the second speed based on the detection timing and the predetermined timing, and to change the conveying speed on the second conveying path to the first speed after conveying the recording material at the second speed on the second conveying path for the determined conveying time period.

3. The image forming system of claim 2, wherein the first controller is further configured to determine the second speed and the conveying time period such that on the second conveying path, the recording material reaches at a first timing a predetermined position corresponding to the sensor and located downstream of the detection position of the sensor in a conveyance direction of the recording material.

4. The image forming system of claim 3, wherein the first controller is further configured to notify the option apparatus of the detection timing by inverting an output level of a signal line outputting two levels.

5. The image forming system of claim 4, wherein the first controller is further configured to notify, before conveying the recording material, the option apparatus of a second timing for obtaining the predetermined timing and the first timing by inverting the output level of the signal line.

6. The image forming system of claim 1, wherein the image forming apparatus includes a plurality of the sensors, and the first controller is further configured to determine the second speed when each of the plurality of the sensors detects the recording material, and to notify the option apparatus of a detection timing by each of the plurality of the sensors.

7. The image forming system of claim 1, wherein the option apparatus is an apparatus for feeding the recording material to the image forming apparatus.

8. The image forming system of claim 1, wherein the image forming apparatus has an image carrier on which an image is formed, and a transfer unit configured to transfer the image formed on the image carrier to recording material, and the first speed is equal to a moving speed of a surface of the image carrier.

9. An option apparatus configured to connect to an image forming apparatus, the option apparatus comprising:

a first conveying path configured to be connected to a second conveying path of the image forming apparatus when the option apparatus is connected to the image forming apparatus, and a controller configured:

to determine, upon receiving from the image forming apparatus a notification of a detection timing of recording material by a sensor detecting a recording material conveyed on the second conveying path, whether the detection timing of the recording material by the sensor is different from a predetermined timing;

and, if the detection timing is different from the predetermined timing, to determine a second speed based on the detection timing and the predetermined timing and change conveying speed of the recording material on the first conveying path from a first speed to the second speed.

10. The option apparatus of claim 9, wherein the image forming apparatus is configured to determine the second speed based on the detection timing and the predetermined timing, and to change the conveying speed of the recording material on the second conveying path from the first speed to the second speed.

11. The option apparatus of claim 10, wherein the controller is further configured to determine a conveying time period for conveying the recording material at the second speed based on the detection timing and the predetermined timing, and to change the conveying speed of the recording material on the first conveying path to the first speed after conveying the recording material at the second speed for the determined conveying time period.

12. The option apparatus of claim 11, wherein the controller is further configured to determine the second speed and the conveying time period such that the recording material reaches a predetermined position of the second conveying path at a first timing that is later than the predetermined timing.

13. The option apparatus of claim 12, wherein the controller is further configured to obtain the predetermined timing and the first timing based on a second timing received from the image forming apparatus.

14. The option apparatus of claim 9, wherein the option apparatus is an apparatus for feeding the recording material to the image forming apparatus.

15. The option apparatus of claim 9, wherein the image forming apparatus has an image carrier on which an image is formed, and a transfer unit configured to transfer the image formed on the image carrier to the recording material, and the first speed is equal to a moving speed of a surface of the image carrier.

16. An image forming apparatus comprising:

a first conveying unit configured to convey a recording material;

a second conveying unit for conveying the recording material, the second conveying unit being located downstream of the first conveying unit in a conveyance direction of the recording material;

a sensor for detecting the recording material;

a first controller configured to control the first conveying unit based on a detection result of the sensor;

a second controller configured to control the second conveying unit; and a signal line connecting the first controller and the second controller, wherein the first controller is further configured to notify the second controller via the signal line of a detection timing of the recording material by the sensor, and, if the detection timing is different from a predetermined timing, to determine a second speed based on the difference between the detection timing and the predetermined timing and change conveying speed of the recording material by the first conveying unit from a first speed to the second speed, and the second controller is further configured to determine, upon receiving a notification of the detection timing, whether the detection timing is different from the predetermined timing, and, if the detection timing is different from the predetermined timing, to determine the second speed based on the difference between the detection timing and the predetermined timing and change the conveying speed of the recording material by the second conveying unit from the first speed to the second speed.

* * * * *